US006308951B1

(12) United States Patent
Allmendinger et al.

(10) Patent No.: US 6,308,951 B1
(45) Date of Patent: Oct. 30, 2001

(54) DEVICE FOR DETECTING A SHEET STACK HEIGHT IN A TRAY

(75) Inventors: Franz Allmendinger, Aichwald; Joachim Buck, Laichingen; Jochen H. Graeber, Bissingen; Volker H. Koenig, Ebersbach; Heinz Michels, Wolfschlugen, all of (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/238,486

(22) Filed: Jan. 27, 1999

(30) Foreign Application Priority Data

Feb. 7, 1998 (DE) ..... 198 04 929

(51) Int. Cl.[7] ..... B65H 7/02

(52) U.S. Cl. ..... 271/265.04; 271/3.15; 271/3.17; 271/229

(58) Field of Search ..... 271/152, 153, 271/3.15, 3.17, 226, 227, 229, 265.04

(56) References Cited

U.S. PATENT DOCUMENTS 4,702,470 * 10/1987 Ishii ..... 271/229
5,620,174 * 4/1997 Taniguro et al. ..... 271/10.12
6,068,254 * 5/2000 Olexy ..... 271/106
6,247,695 * 1/2001 Linder et al. ..... 271/265.04

FOREIGN PATENT DOCUMENTS 0 768 263 A1 4/1997 (EP) ..... B65H/39/11

* cited by examiner

*Primary Examiner*—Donald P. Walsh
*Assistant Examiner*—Mark J. Beauchaine

(57) ABSTRACT

The invention relates to a device (1) for detecting a stack height of sheets (21) stacked in an input and/or output tray (2) of an apparatus, said device comprising a feeler (10) cyclically controlled and driven by means of a drive unit (12) and a control unit toward the sheet stack (21) in the stacking direction into a sensing position, and a sensor (11) detecting the sheet stack height and recognizing the sensing position of the feeler. To create a device which on the one hand has a simple, compact design along with freely selectable measurement steps and high measurement accuracy at each stack height, and on the other hand allows quiet and vibration-free operation, a controllable stepping motor (120) is provided, by means of which the feeler (10) is movable from a predeterminable initial position (y, z') toward the sheet stack (21) and into the sensing position (y', z), such that the stack height can be determined on the basis of the number of motor steps detected from the initial position until the sensing position of the feeler is recognized.

17 Claims, 3 Drawing Sheets

DEVICE FOR DETECTING A SHEET STACK HEIGHT IN A TRAY

CROSS-REFERENCE TO RELATED APPLICATIONS

The invention claims priority of German Patent Application No. 198 04 929.3 filed Feb. 07, 1998, titled "Device For Detecting A Sheet Stack Height In A Tray". by Franz Allmendinger, et al.

FIELD OF THE INVENTION

The invention relates generally to a device for detecting the stack height of sheets stacked in an input and/or output tray of an apparatus such as a printer or copier.

BACKGROUND OF THE INVENTION

Devices for detecting stack height of sheets are known in the art. In EP-0 768 263-A1, a conventional device for detecting stack height is disclosed. According to this prior art development, means is provided for detecting a stack height in at least one collecting tray of an output unit of a printer. More particularly, a feeler is provided in the form of a pivotable feeler bracket movable cyclically against the sheet stack into a sensing position. At some position above the sheet stack and in the stacking direction, a sensor in the form of an opto-electronic sensor senses the position of the feeler and detects the sheet stack height. The feeler bracket in the aforementioned prior art development has at a first end a feeler/pressure finger pivoted by means of a microprocessor-controlled reciprocating magnet about its center rotation axis. The reciprocating magnet is joined via a spring element at its reciprocating armature to a second end of the feeler bracket located opposite the first, at which a switching tab for actuating the sensor is also arranged. The feeler bracket, sensor, and reciprocating magnet are arranged outside the collecting tray and in front of the end-surface wall of the collecting tray, i.e. the front alignment edge for the paper sheets delivered into the collecting tray. With the feeler bracket in an initial position, the feeler finger is located above and out of engagement with the front region of the sheet stack, and the switching tab is outside the sensing region of the sensor. During the sensing cycle, the feeler bracket pivots through a slot in the end-surface wall into the collecting tray and, with the feeler finger, onto the sheet stack, whereby the switching tab pivots in the direction of the sensor. Not until the maximum permissible stack height is reached is the sensor actuated or covered by means of the switching tab, and a signal is sent to the control unit to stop sheet in-feed. Alternative embodiments have sensor means (multiple sensors) or switching tabs (with multiple slots) for detecting intermediate values of the sheet stack height. To detect a first sheet in the collecting tray, a further sensor is arranged in its bottom or deposition surface.

A major shortcoming of the above and other similar existing sheet stack height detecting devices is that the reciprocating magnet generates severe vibration and noise. Further, such devices require complex sensor means to detect exact intermediate values of the sheet stack height and to detect the first sheet in the collecting tray. A further shortcoming of existing developments is that the means for detecting the stack height are located in the region of a possible transport path for the completed sheet stack, or in the removal/input region of the collecting tray.

Therefore, a need persists in the art for a device for detecting stack height of sheets stacked in an input and/or output tray of an apparatus that is compact, and simple to construct, cost effective to manufacture and relatively simple to operate.

SUMMARY OF THE INVENTION

It is, therefore, an object of the invention to provide a device for detecting the stack height of stacked sheets that has a compact configuration.

Another object of the invention is to provide such a device that has freely selectable measurement steps and high measurement accuracy at each stack height.

Yet another object of the invention is to provide a device that operates essentially noise-free and vibration-free.

Still another object of the invention is to provide a device that operates in an automated environment without interrupting sheet in-feed or removal.

It is a feature of the invention to provide a controllable stepping motor in which a feeler is movable from a predetermined initial position toward the sheet stack and then into a sensing position. The stack height of the sheets can then be determined on the basis of the number of motor steps detected from the initial position until the sensing position of the feeler is recognizcd.

To achieve these and other objects of the invention, there is provided a device for detecting the stack height of sheets stacked in an input and/or output tray of an apparatus. The device comprises a feeler cyclically controlled and driven by means of a drive unit and a control unit toward the sheet stack in the stacking direction into a sensing position. A sensor detects the sheet stack height and recognizes the sensing position of the feeler. Further, the device has a controllable stepping motor which enables the feeler to move from a predetermined initial position (y, z') toward the sheet stack and into the sensing position (y', z). In this way, the stack height can be determined on the basis of the number of motor steps detected from the initial position until the sensing position of the feeler is recognized.

There are numerous advantages of the present invention over prior art developments. In one respect, the stepping motor, or the stepping motor in conjunction with a control can having a cam plate, advantageously provides a step spacing which is smaller than a smallest sheet thickness of the sheet types that can be used. In another respect, the sensing cycle of the feeler is either automatically or manually adjustable both as a function of a number of sheets delivered to or discharged from the collecting tray and as a function of a sheet thickness of a sheet type being used. Further, it is an advantage that the feeler is movable by means of the stepping motor or the stepping motor in conjunction with the cam plate. The feeler moves with a velocity profile such that the linear velocity of the feeler is diminished in the region before the sensing position, the initial position, and a removal/input position.

Moreover, it is an advantage of the present invention that output signals from sensors positioned about the stack for determining stack height can be detected by a control unit comprising a microprocessor, a counting device and a calculation means.

Furthermore, another advantage of the present invention is that the feeler has a feeler finger arranged on a support that can be moved in the stacking direction by the stepping motor. The feeler finger is arranged on the support so as to be movable back and forth in the movement direction of the support against a spring element, and can be moved and pressed with its feeler tip against the sheet stack.

In addition, advantageously, the feeler, the sensor, and the drive unit with the stepping motor and the radial cam are arranged above the sheet stack and tray.

Moreover, advantageously, means for aligning a respective topmost sheet of the sheet stack and/or for temporarily retaining delivered sheets are displaceable, as a function of a determined sheet stack height, into their predetermined working position with respect to the sheet stack.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
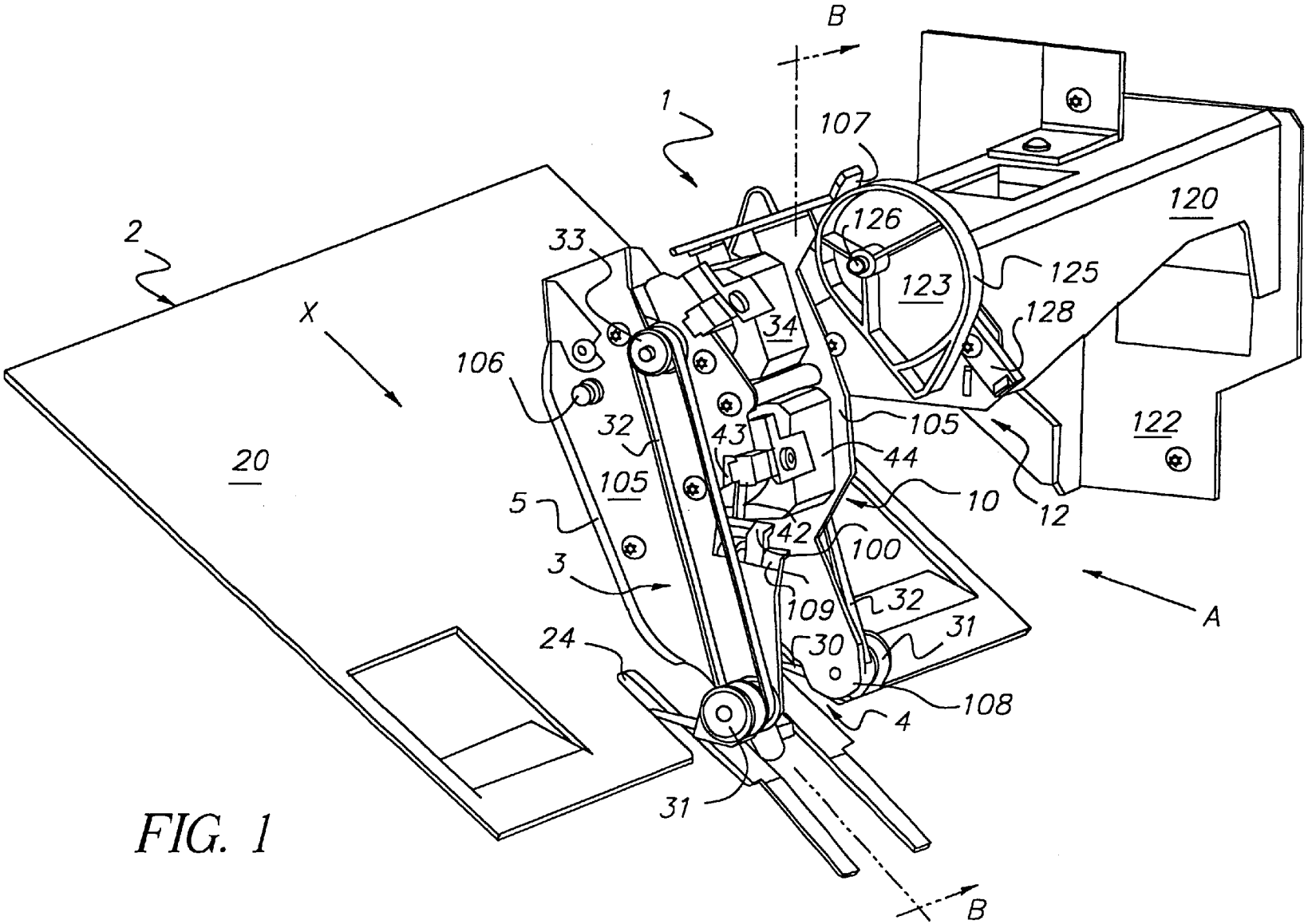
FIG. 1 is a perspective view of the device according to the invention together with a sheet retaining unit and a sheet aligning unit.
Figure 2:
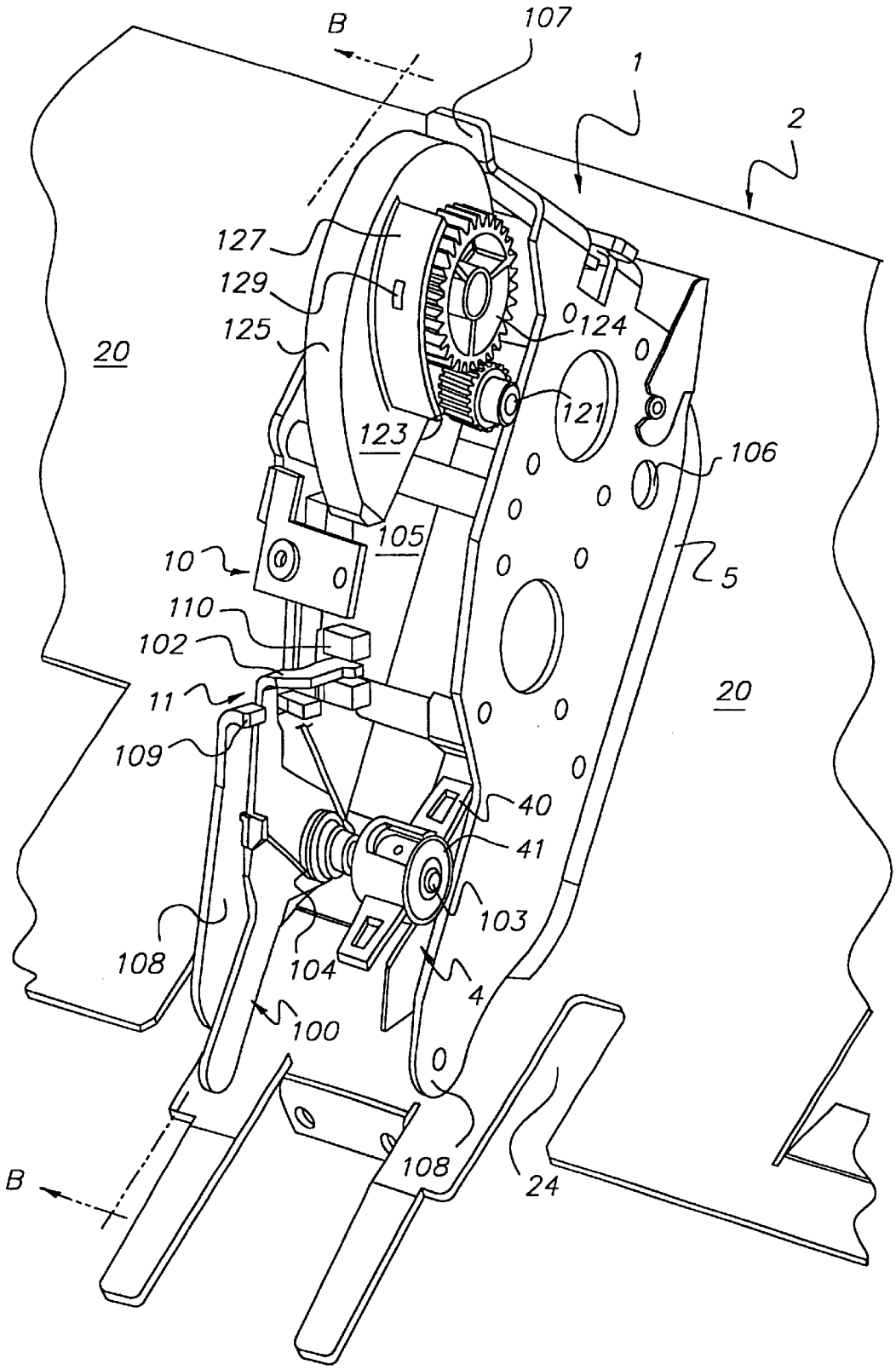
FIG. 2 is an enlarged front (direction shown by arrow A) perspective view of the device depicted in FIG. 1, omitting any components which interfere with visibility, in particular the sheet retaining and aligning units.
Figure 3:
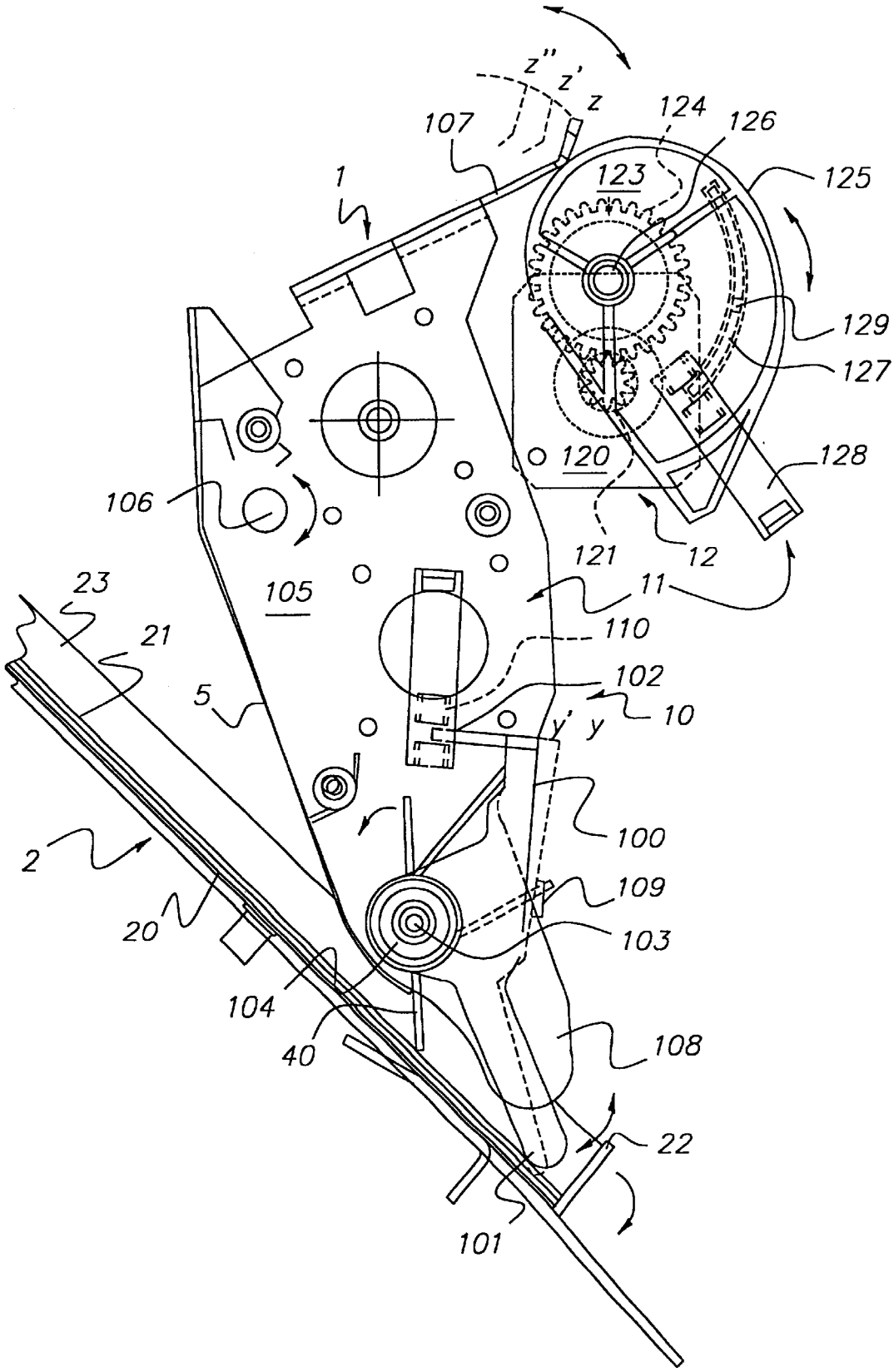
FIG. 3 shows the device according to the invention in a sensing position, in a side view along a section line B—B as depicted in FIGS. 1 and 2.

Turning now to the drawings and in particular to FIGS. 1–3, device 1 of the invention is illustrated for detecting a stack height of sheets 21 delivered substantially horizontally, and stacked vertically, in an inclined collecting tray/discharge tray 2 of an apparatus, such as a copier or printer. As best seen in FIG. 3, device 1 has a feeler 10 controlled and driven cyclically against sheet stack 21 by means of a drive unit 12 and a control unit (not shown) in the stacking direction into a sensing position. Sensor 11 detects the sheet stack height and recognizes the sensing position of the feeler 10. Skilled artisans will appreciate that device 1 can be used in a variety of apparatus (not depicted) or document handling equipment, for example a copier or printer, and is preferably used to output completed customer-specific copying jobs.

Moreover, skilled artisans will appreciate that it is within the contemplation of the invention that device 1 has utility with single sheets in a input tray or a vertical stack of sheets in a tray. In either instance, device 1 is operable with the input tray having, in addition to the inclined orientation depicted clearly in FIG. 3, a non-inclined (horizontal) orientation, or a vertical orientation (with horizontal sheet stacking direction and feeler movement). Furthermore, sheets of different types, having different thickness, sizes, and weights, can be used with device 1 of the invention.

Referring again to FIGS. 1, 2, and 3, device 1, in a sensing position y', z, has on a holder 122 arranged in the apparatus, drive unit 12, feeler 10, and sensor 11, which are together arranged above sheet tray 2 and sheet stack 21. As best seen in FIGS. 1 and 3, drive unit 12 contains a stepping motor 120, controllable by the control unit that controls the movements of feeler 10. Feeler 10 is movable from a predetermined initial position y, z', against sheet stack 21 and into sensing position y', z. During these movements of feeler 10, the stack height can be determined based on the number of motor steps detected by the control unit from the initial position until the sensing position of the feeler 10 is recognized.

Referring to FIGS. 2 and 3, arranged about drive unit 12 is control cam 123 and radial cam 125. Control cam 123 is rotatable about a rotation axis 126. Radial cam 125, which can be driven by stepping motor 120 via its drive pinion 121 and a gear 124 is joined rigidly to the control cam 123. Referring to FIG. 1, feeler 10 has a support 105 that is movable in the stacking direction by stepping motor 120 and control cam 123. Feeler 10, moreover, has feeler finger 100 arranged thereon. Feeler finger 100 is arranged so as to move freely back and forth on support 105 along the movement direction of the support, and can be moved and pressed with its feeler tip 101 in the stacking direction against sheet stack 21.

As shown in FIGS. 2 and 3, feeler finger 100 on support 105 can be biased by means of a spring element 104, e.g. a torsion spring, in the direction of sheet stack 21 into an initial position y against a stop 109 on the support. Movements of feeler finger 100 can further be defined by the movements of support 105 in the direction of the sheet stack, i.e., feeler finger 100 can be moved into sensing position y' against sheet stack 21 or against a sheet support surface 20 of sheet tray 2. When feeler finger 100 is in the aforementioned positions, a sensor 110 of sensor means 11, arranged on the support, is actuated by a switching tab 102, spaced away from feeler tip 101, of feeler finger 100. In this configuration, feeler finger 100 is arranged pivotably about its center axis 103 on support 105, and switching tab 102 is located on the end of the feeler finger 100 located opposite feeler tip 101.

Referring to FIGS. 1 and 2, support 105 is arranged in the form of a suspended "U" pivotably about a pivot pin 106 at the height of rotation axis 126 of control cam 123. At an upper end or rear part of support 105 there is arranged an actuation lever 107 which rests on the upper outer rim of the control cam, i.e. radial cam 125. As best seen in FIG. 3, support 105 that supports feeler 10 and sensor 110 is pivotable with its lower end 108 facing toward sheet stack 21. Radial cam 25 of control cam 123 that controls stepping motor 120 together with actuation lever 107 provide the means of pivoting support 105 from sensing position z upward to initial position z'. During one such pivoting movement of support 105, feeler finger 100 is spaced away from the sheet stack 21 and/or sheet support surface 20 of sheet tray 2. During another pivoting movement, support 105 bearing feeler 10 and sensor 11 can be pivoted back downward into sensing position z under its own weight and under the control of radial cam 125. In addition, support 105 with feeler 10 and sensor 110 can be pivoted into a topmost or removal/input position z" for sheet stack 21 and/or tray 2.

Referring once again to FIGS. 2 and 3, in order to recognize initial position z' and removal/input position z" of support 105, there are arranged in the region of control cam 123 a second sensor 128 or an additional third sensor (not depicted) for the removal/input position 211. With further reference to FIGS. 2 and 3, on control cam 123 a switching cam 127 having at least one sensing mark 129 for the second or third sensor may also be added. In this context, sensor 11, or sensors 110, 128, are configured in known fashion as opto-electronic, electromechanical, or magnetic sensors.

Referring to FIG. 3, the step count of stepping motor 120 for determining the height of sheet stack 21 can be detected in the above manner. In particular, the step count can be detected between the signal output from second sensor 128 characterizing initial position z' or from the third sensor characterizing removal/input position z" and the signal output from first sensor characterizing sensing position y', z. The control unit, which has a microprocessor, a counting device, a calculation means, and memory are used to determine step count.

Stepping motor 120 has in this context, in conjunction with radial cam 125 of control cam 123, a step spacing which is smaller than the smallest sheet thickness of the sheet types that can be used. In addition, the sensing cycle of feeler 10 can be adjusted automatically by means of a control program of the control unit. This may be accomplished by automatic detection of the number of sheets and sheet type(s) input into the apparatus or into tray 2 or it may be accomplished manually by, for instance, entering the sheet type(s) and the customer-specific number of sheets per stack. The sensing cycle is the time between sensing operations as a function of the number of sheets delivered to or from tray 2 and of the sheet thickness of the sheet type being used.

In an alternative embodiment (not depicted) of the invention, a linearly movable feeler 10 equipped with a toothed rack or a support (with linearly movable feeler finger with and without spring clement) movable linearly toward the sheet stack, can be driven directly by stepping motor 120. In this embodiment, stepping motor 120 has a step spacing which is smaller than a smallest sheet thickness of the sheet types that can be used. In addition, feeler 10 can be moved by means of stepping motor 120 with a velocity profile such that the linear velocity of the feeler is diminished in the region before sensing position y', z, initial position y, z', and removal/input position y, z".

Referring again to FIGS. 1–3 , there are arranged on support 105, in addition to feeler finger 100, further functional units, such as an aligning unit 4 with means for aligning a respective topmost sheet of sheet stack 21. Also, support 105 may support a retaining unit 3 with means for temporarily retaining or collecting delivered sheets. Further, support 105 may support a deflection panel 5 for the topmost sheet delivered onto the sheet stack 21. In an alternative embodiment (not depicted), only one of the two functional units 3 or 4 is provided. In a further embodiment (not depicted), functional units 3, 4 are each installed on a further support (not shown) separate from feeler support 105.

Referring to FIG. 1, retaining unit 3 has its own drive mechanism, consisting of a drive motor 34 with drive rollers 33 attached at both ends of its drive shaft, drive belts 32, and output drive rollers 31 attached at lower end 108 of support 105. Arranged on each one of the output drive rollers 31 is a separator finger 30. Output drive rollers 31 are driven by drive motor 34. To retain and collect the sheets, output drive rollers 31 can be pivoted into the delivery path of the sheets in the region of the front edge of sheet tray 2 and, if tray 2 was previously empty, also pivoted into recesses in sheet support surface 20.

Referring to FIG. 1, aligning unit 4 has its own drive mechanism comprising drive motor 44 with drive roller 43, drive belts 42, and output drive roller 41 attached at the lower end of the support 105. A rotatable elastic vane wheel 40, joined to the output drive roller, is provided, by means of which, via its frictional force, the respective topmost delivered sheet can be transported and aligned against side stop 23 and against front stop 22 of tray 2.

Referring to FIG. 1, retaining means 3 (separator finger 30) and aligning means 4 (vane wheel 40) can be set to their predetermined working positions with respect to the sheet stack 21. These predetermined working positions are determined as a function of sheet stack height in tray 2 (determined by the control unit). Drive unit 12 (stepping motor 120 and control cam 123) of feeler 10 (support 105 and feeler finger 100) provides the means for setting the positions of retaining means 3 and aligning means 4. The working position of means 3, 4 corresponds to the predetermined initial position y, z' of feeler 10, 100, 105, in which feeler finger 100 is spaced away from sheet stack 21 with its feeler tip 101.

Referring to FIG. 3, radial cam 125 of control cam 123 has, in this context, a plurality of radial cam segments, joined to one another, which are matched to the linear motion sequences of feeler 10, aligning means 4, and retaining means 3. The cam segments for feeler 10 have a lesser slope in the region of sensing position y', z, initial position y, z', and removal/input position y', z" in order to diminish the linear velocity.

The manner of operation of device 1 of the invention is set forth below.

In the idle operating position (not shown) of device 1, feeler 10 is brought into a predetermined initial position by means of stepping motor 120 controlled by the control unit, and aligning means 4 are brought into a predetermined working position above an empty sheet tray 2. Sensing of a sheet stack height 21, after the introduction and stacking of a predetermined number of sheets in tray 2, is accomplished in accordance with the working steps below:

a) Start stepping motor 120 by means of the control program of the control unit, to move feeler 10 (support 105 and feeler finger 100) at relatively low velocity from the first predetermined initial position, spaced away from sheet stack 21, in the stacking direction toward the sheet stack;

b) Begin counting the stepping pulses controlling the stepping motor upon a signal output from second sensor 128 characterizing initial position y, z';

c) Increase the velocity of the stepping motor in accordance with the defined velocity profile, by means of the control program or control unit;

d) Diminish the velocity of the stepping motor, in accordance with the defined velocity profile, shortly before the sensing position on the sheet stack is reached;

e) Terminate counting upon a signal output from first sensor 110 characterizing sensing position y', z ;

f) Stop the stepping motor and store the count in the control unit memory;

g) Calculate the sheet stack height by means of the control unit computer, by subtracting the step count just detected from a step count detected when the tray is empty (a reference step count), i.e. by calculating a difference;

h) Start the stepping motor by means of the control unit in the opposite direction of rotation, and transport the feeler back into the previous initial position with the previous velocity profile.

According to an alternative method, return transport (step h) is accomplished by means of the following modified steps:

h1) Transport the feeler back to a new initial position at a distance which is greater by an amount equal to the difference from the previous stack height;

h2) Increment the reference step count by an amount equal to the difference, to constitute a new reference step count.

According to a further alternative method, without a second sensor 128 on radial cam 123, starting of stepping motor 120 and initiation of the counting of stepping pulses (steps a and b) are accomplished simultaneously, beginning or proceeding from the initial position determined either by the original reference step count or the respective recalculated reference step count.

The invention has been described with reference to certain preferred embodiments thereof. However, it will be appreciated that variations and modifications can be effected by a person of ordinary skill in the art without departing from the scope of the invention.

PARTS LIST

1. Device for detecting sheet stack height
2. Input/output tray for sheets
3. Retaining unit/means for sheets
4. Aligning unit/means for sheets
5. Deflection panel for sheets
10. Feeler
11. Sensor (feeler)
12. Drive unit (feeler)
20. Support surface for sheets (input/output tray)
21. Sheets/sheet stack
22. Front stop for sheets (input/output tray)
23. Side stop for sheets (input/output tray)
24. Cutout for separator finger (retaining unit)
30. Separator finger for sheets (retaining unit)
31. Output drive roller (for separator finger)
32. Drive belts
33. Drive roller (drive motor)
34. Drive motor (retaining unit)
40. Vane wheel (aligning unit)
41. Output drive roller (for vane wheel)
42. Drive belts
43. Drive roller (for vane wheel)
44. Drive motor (aligning unit)
100. Feeler finger (feeler)
101. Feeler tip (feeler finger)
102. Switching tab (feeler finger)
103. Center/rotation axis of feeler finger
104. Spring element/torsion spring on feeler finger
105. Support (feeler)
106. Pivot pin/rotation point (support)
107. Actuation lever on support
108. Lower end of support
109. Stop for feeler finger (on support)
110. First sensor
120. Stepping motor (drive unit for sensing means)
121. Drive pinion (stepping motor)
122. Holder (drive unit for sensing means)
123. Control cam (drive unit for sensing means)
124. Gear on control cam
125. Radial cam on control cam
126. Rotation axis of control cam
127. Switching cam (control cam)
128. Second sensor (switching cam)
129. Scanning mark on switching cam
x Sheet delivery direction (input/output tray)
y Starting position of feeler finger (feeler)
y' Sensing position of feeler finger
z Sensing position of support (feeler)
z' Initial position/working position of support
z" Removal/input position of support

What is claimed is:

1. Device (1) for detecting a stack height of sheets (21) stacked in an input and/or output tray (2) of an apparatus, said device comprising a feeler (10) cyclically controlled and driven by means of a drive unit (12) and a control unit toward the sheet stack (21) in the stacking direction into a sensing position, and a sensor (11) detecting the sheet stack height and recognizing the sensing position of the feeler, characterized in that a controllable stepping motor (120) is provided, by means of which the feeler (10) is movable from a predeterminable initial position (y, z') toward the sheet stack (21) and into the sensing position (y', z), such that the stack height can be determined on the basis of the number of motor steps detected from the initial position until the sensing position of the feeler is recognized.

2. Device as defined in claim 1, wherein the feeler (10) has a feeler finger (100) arranged on a support (105) that can be moved in the stacking direction by the stepping motor (120); and the feeler finger is arranged on the support so as to be freely movable back and forth in the movement direction of the support, and can be moved and pressed, with its feeler tip (101), against the sheet stack (21).

3. Device as defined in claim 2, wherein the feeler finger (100) on the support (105) can be brought by means of a spring element (104) in the direction of the sheet stack (21) into an initial position (y) against a stop (109) on the support, and by means of a movement of the support in the direction of the sheet stack, can be moved into the sensing position (y') against the sheet stack or against a sheet support surface (20) of the sheet tray (2), at which point a sensor (110) of the sensor means (11), arranged on the support, is actuated by a switching tab (102), spaced away from the feeler tip (101), of the feeler finger.

4. Device as defined in claim 3, wherein the feeler finger (100) is arranged pivotably about its center axis (103) on the support (105); and the switching tab (102) is located on the end of the feeler finger located opposite the feeler tip (101).

5. Device as defined in claim 1, wherein the feeler (10), the sensor (11), and the drive unit (12) with the stepping motor (120) are arranged above the sheet stack (2) and tray (21).

6. Device as defined in claim 1, wherein a control cam (123) having a radial cam (125) arranged on the drive unit (12) is driven by the stepping motor (120), and is movable, by means of the feeler (10) having the feeler finger (100) and support (105), toward the sheet stack (21) in the stacking direction.

7. Device as defined in claim 6, wherein the support (105) is arranged pivotably about a pivot pin (106) and has an actuation lever (107); the support (105) being pivotable with its lower end (108) which faces toward sheet stack (21) and carries feeler (10 and sensor (11), by means of the stepping-motor-controlled radial cam (125) of the control cam (123) and the actuation lever (107), upward to the initial position (z'); and the support (105) with the means (10; 11) arranged thereon can be pivoted back downward into the sensing position (z) under its own weight and under the control of the radial cam (125).

8. Device as defined in claim 7, wherein the support (105) with the feeler (10) and the sensor (11) can be pivoted into a topmost removal/input position (z") characteristic for the sheet stack (21) and/or tray (2).

9. Device as defined in claims 7, further comprising a second sensor (128) of the sensor (11) to recognize the initial position (z') and the removal/input position (z"), or an additional third sensor for the removal/input position (z") of the support (105), is arranged in the region of the control cam (123); and a switching cam (127) having at least one sensing mark (129) for the second or third sensor is arranged on the control cam (123).

10. Device as defined in claim 1, wherein the sensor means (11; 128) are configured as opto electronic, electromechanical, or magnetic sensors.

11. Device as defined in claim 1, wherein means for aligning (4) a respective topmost sheet of the sheet stack (21) and/or means for temporarily retaining (3) delivered sheets are displaceable, as a function of a determined sheet stack height, into their predetermined working positions with respect to the sheet stack.

12. Device as defined in claim 11, wherein the aligning means (4) and the retaining means (3) are arranged on the support (105); and when the means are brought into their working positions, the feeler finger (100) is spaced away from the sheet stack (21), such that the working position of the means (3, 4) corresponds to the predetermined initial position (y, z') of the feeler (10).

13. Device as defined in claim 1, wherein the number of motor steps between a signal output from the second sensor (128) characterizing the initial position (z'), or from the third sensor characterizing the removal/input position (z"), and a signal output from the first sensor (110) characterizing the sensing position (y', z), is detectable by means of the control unit which has a microprocessor, a counting device, a calculation means, and a memory, and the sheet stack height (21) can be determined thereby.

14. Device as defined in claim 13, wherein the stepping motor (120), in conjunction with the radial cam (125) of the control cam (123), has a step spacing which is smaller than a smallest sheet thickness of the sheet types that can be used; and the sensing cycle of the feeler (10) is adjustable, automatically or manually, as a function of the number of sheets delivered to or discharged from the collecting tray (2) and of a sheet thickness of the sheet type being used.

15. Device as defined in claim 14, wherein the radial cam (125) has a plurality of radial cam segments, joined to one another, which are matched to the linear motion sequences of the feeler (10), aligning means (4), and retaining means (3); and the cam segments for the feeler (10) have a lesser slope in the region of the sensing position (y', z), initial position (y, z'), and removal/input position (y', z") in order to diminish the linear velocity.

16. Device as defined in claim 14, wherein the feeler (10) can be moved by means of the stepping motor (120) with a velocity profile such that the linear velocity of the feeler is diminished in the region before the sensing position (y', z), initial position (y, z'), and removal/input position (y, z").

17. Device as defined in claim 1, wherein the stepping motor (120) has a step spacing which is smaller than a smallest sheet thickness of the sheet types that can be used; and the sensing cycle of the feeler (10) is adjustable, automatically or manually, as a function of the number of sheets delivered to or discharged from the tray (2) and of the sheet thickness of the sheet type being used.

* * * * *